US012583641B1

(12) United States Patent
Sandfort et al.

(10) Patent No.: US 12,583,641 B1
(45) Date of Patent: Mar. 24, 2026

(54) CORNER BOARD APPLICATION SYSTEM FOR LOADS AND RELATED METHODS

(71) Applicant: Capital Recovery Group Technologies, LLC, Louisville, KY (US)

(72) Inventors: Christopher Sandfort, Louisville, KY (US); Gregory Buth, Louisville, KY (US)

(73) Assignee: Capital Recovery Group Technologies, LLC, Louisville, KY (US)

( * ) Notice: Subject to any disclaimer, the term of this patent is extended or adjusted under 35 U.S.C. 154(b) by 0 days.

(21) Appl. No.: 18/737,280

(22) Filed: Jun. 7, 2024

Related U.S. Application Data

(60) Provisional application No. 63/532,192, filed on Aug. 11, 2023, provisional application No. 63/471,636, filed on Jun. 7, 2023.

(51) Int. Cl.
*B65B 13/00* (2006.01)
*B65B 13/18* (2006.01)

(52) U.S. Cl.
CPC ..... *B65B 13/181* (2013.01)

(58) Field of Classification Search
CPC ..... B65B 13/181; B65B 13/04; B65B 53/00; B65B 61/00; B65B 11/00; B65B 35/50; B65B 61/20
USPC ..... 53/139.7, 399, 410, 441, 556, 587, 128, 53/397
See application file for complete search history.

(56) References Cited

U.S. PATENT DOCUMENTS

| | | | | |
|---|---|---|---|---|
| 4,897,980 A * | 2/1990 | Geyser | B65B 5/028 | 53/139.5 |
| 5,226,280 A * | 7/1993 | Scherer | B65B 13/181 | 221/211 |
| 5,546,730 A * | 8/1996 | Newell | B65B 11/585 | 53/399 |
| 2011/0180450 A1* | 7/2011 | Hainer | B65D 71/04 | 53/410 |
| 2015/0128530 A1* | 5/2015 | Brunson | B65B 11/02 | 53/441 |

* cited by examiner

*Primary Examiner* — Jacob A Smith
(74) *Attorney, Agent, or Firm* — Dickinson Wright PLLC; Andrew D. Dorisio

(57) ABSTRACT

A system is provided for delivering one or more corner boards for application to one or more corners of a load. The system includes a magazine for receiving the one or more corner boards, the magazine including a loading end and a dispensing end. A pusher is provided for pushing the one or more corner boards towards the dispensing end of the magazine. A holder is also provided for holding the one or more corner boards in an upright position within the magazine, and a gate serves to engage at least one of the one or more corner boards adjacent the dispensing end for application to the one corner of the load. A control arrangement and related methods are also disclosed.

19 Claims, 14 Drawing Sheets

CORNER BOARD APPLICATION SYSTEM FOR LOADS AND RELATED METHODS

This application claims the benefit of U.S. Provisional Patent Application Ser. No. 63/471,636, filed Jun. 7, 2023, and U.S. Provisional Patent Application Ser. No. 63/532,192, filed Aug. 11, 2023, the disclosures of which are incorporated herein by reference.

TECHNICAL FIELD

This disclosure relates generally to a system for applying one or more corner boards to a load and, more particularly, to a system for automatically placing a corner board on one or more of the corners of a load prior to or during wrapping of the load in order to enhance the stability thereof during shipping or storage.

BACKGROUND

In the course of some manufacturing processes, products are often stored in containers, such as boxes, and stacked as palletized loads intended for delivery to a third party. The boxes are usually of a cuboid shape and, thus, the resulting stack forming the load presents four right-angled vertical edges, or corners. Protectors or covers in the nature of generally L-shaped, elongated corner boards provide protection and stabilization during the shipment and storage of such loads. Often, the application of corner boards is performed in conjunction with wrapping of the load to maintain the stacked configuration during transport or storage. Examples are described in U.S. Pat. Nos. 5,546,730, 5,758,470, and 6,883,293, the disclosures of which are incorporated by reference herein.

Placement of such corner boards along the corners of the load is a time-consuming process, especially if done manually. For purposes of security and compactness, precise application of the corner boards is desirable to ensure the wrapped load remains intact during transport or storage. Efficient application of the corner boards is also desirable to save time and reduce costs, especially when the securement of the load is done as part of an overall manufacturing line.

Accordingly, a need is identified for a corner board application system that addresses the foregoing issues and perhaps others yet to be appreciated. The system would be able to apply the corner boards to the load automatically in a rapid and precise manner, including by detecting the location of the corners of the load as part of the automated application process, if desired. The system would be suitable for use with corner boards of various shapes and sizes to meet the demands of different load dimensions. The system would also be capable of operating in a highly efficient, cost-effective manner, such as for example in a continuous fashion in connection with a stack of corner boards, which may be reloaded without interrupting the application process. By transforming what was once a rate-limiting step in the packaging process into a user-friendly, high-speed operation, the corner board application system would contribute to higher efficiency, which ultimately leads to higher productivity and ultimately increased profitability.

SUMMARY

According to one aspect of the disclosure, a system for delivering one or more corner boards for application to one or more corners of a load. The system comprises a magazine for receiving the one or more corner boards, the magazine including a loading end and a dispensing end. A pusher is provided for pushing the one or more corner boards towards the dispensing end of the magazine. A holder is also provided for holding the one or more corner boards in an upright position within the magazine. A gate serves to engage at least one of the one or more corner boards adjacent the dispensing end of the magazine for application to the one corner of the load.

In one embodiment, the magazine comprises a plurality of lanes. The magazine further includes a conveyor for supporting the one or more corner boards, and such a conveyor may be associated with each lane. The conveyor may comprise a passive roller conveyor adapted to provide low-friction support for the one or more corner boards.

The holder may comprise a pair of opposing brushes. In one particular embodiment, the holder comprises at least two pairs of brushes. The pairs of brushes include an upper pair for engaging an upper portion of the one or more corner boards and a lower pair for engaging a lower portion of the one or more corner boards. The opposing brushes extend longitudinally along the interior of the magazine. The one or more corner boards have a width, and a width dimension between an inner end portion of each brush is less than the width of the one or more corner boards.

The gate may comprise one or more finger for engaging the at least one corner board in a closed position and having an open position for releasing the at least one corner board. The wherein the pusher comprises a linear actuator attached to a support for urging the one or more corner boards towards the dispensing end of the magazine. The support is adapted to be manually retracted to overcome an applied force urging the support towards the dispensing end, thereby allowing for the loading of the one or more corner boards into the magazine. A movable guard may be connected to the pusher for guarding the dispensing end of the magazine.

In one embodiment, the system further includes one or more sensors for locating the one or more corners of the load and generating an output signal. A controller is provided for controlling a robot for placement of the one or more corner boards based on the output signal. A conveyor with at least one sensor of the one or more sensors located on each side thereof serves to track a position of the load along the conveyor. The one or more sensors may be located on an arm of the robot.

According to a further aspect of the disclosure, a system for delivering one or more corner boards for application to one or more corners of a load. The system comprises a magazine adapted for receiving and holding a stack of the one or more corner boards, the magazine including a loading end and a dispensing end. A pusher is provided for engaging a trailing corner board of the stack of the one or more corner boards for movement towards the dispensing end of the magazine. The system further includes a holder for holding the stack of the one or more corner boards in an upright position within the magazine. A gate is also provided for engaging a leading corner board of the stack of the one or more corner boards adjacent the dispensing end for application to one corner of the load.

In one embodiment, the pusher comprises a linear actuator attached to a support for urging the stack of the one or more corner boards towards the dispensing end of the magazine. A movable guard may also be connected to the pusher for guarding the dispensing end of the magazine.

Still a further aspect of the disclosure pertains to a method for delivering one or more corner boards for application to one or more corners of a load. The method comprises pushing at least one corner board held in an upright position in a magazine towards the load. The method further comprises dispensing the at least one corner board from the magazine for application to the load.

In one embodiment, the pushing step occurs during or after the dispensing step, allowing for the continuous reloading of the one or more corner boards. The pushing step may comprise providing low-friction support while conveying the one or more corner boards towards the load. The pushing step may also comprises actuating the movement of a support for urging the one or more corner boards towards the load.

The method may further include the step of retracting the support for the loading of the one or more corner boards. Still further, the method may involve positioning the one or more corner boards in a holder comprising opposing brushes. The dispensing step may comprise engaging a leading corner board of the one or more corner boards and releasing the leading corner board for application to at least one of the one or more corners of the load.

The method in one embodiment may also involve tracking a position of the load during conveyance. The method may further including generating an output signal representative of the position of the load. Based on the output signal, the method may include the step of controlling a robotic application of the one or more corner boards to at least one of the one or more corners of the load.

BRIEF DESCRIPTION OF THE DRAWINGS

The novel features of the disclosure are set forth with particularity in the appended claims. A better understanding of the features and advantages of the present disclosure will be obtained by reference to the following detailed description that sets forth illustrative embodiments, in which the principles of the invention are utilized, and the accompanying drawings of which:

DETAILED DESCRIPTION

Figure 1:
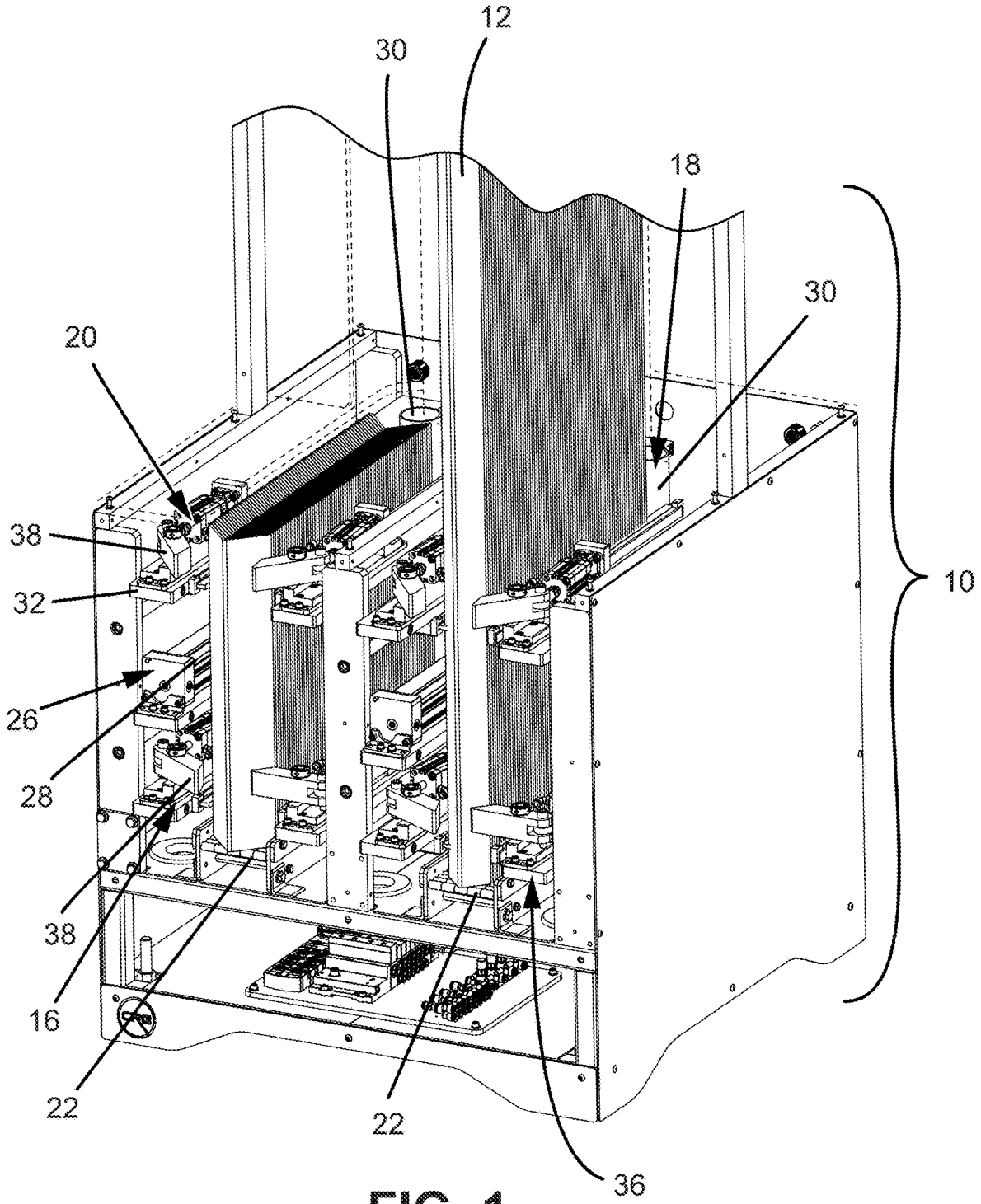
FIG. 1 is a front view of a corner board application system according to one aspect of the disclosure.
Figure 12:
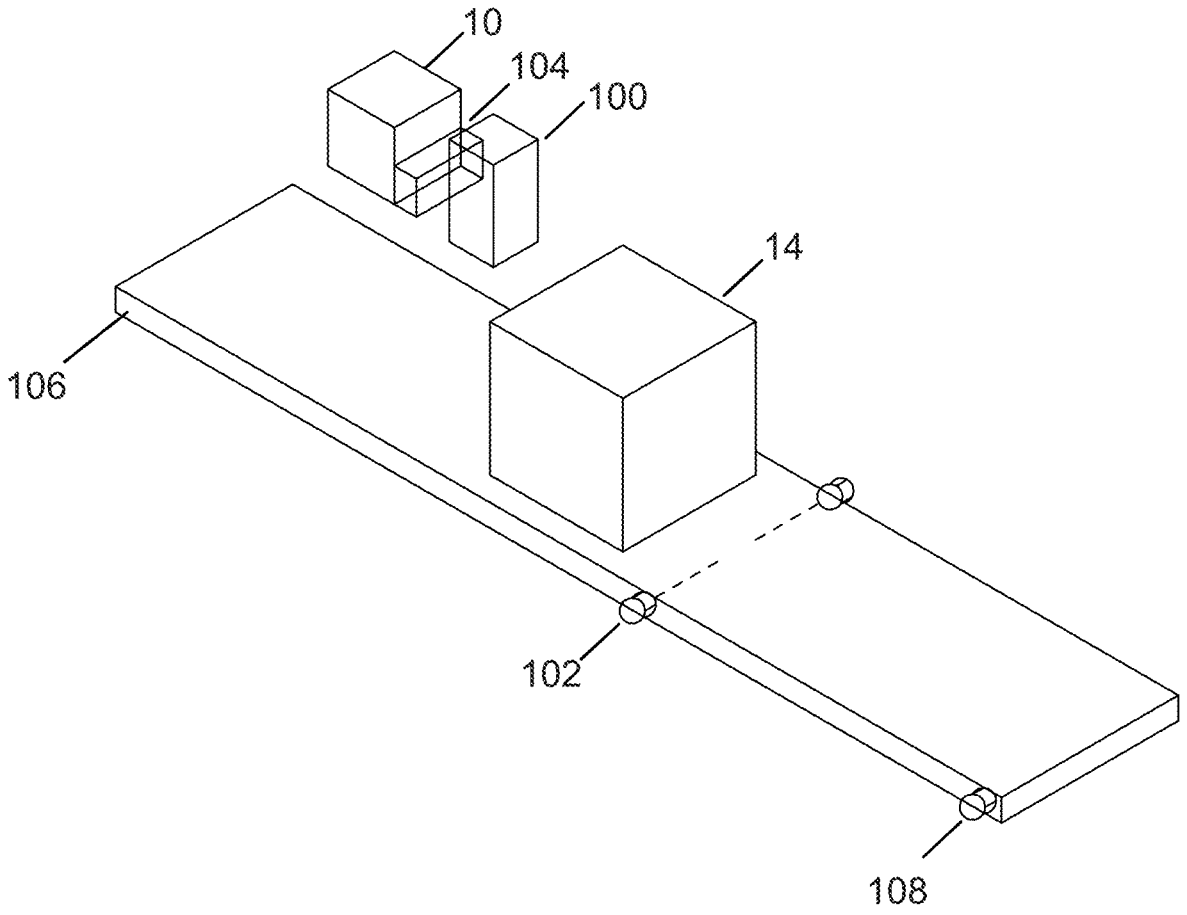
FIG. 12 is a view of the load detection process for the corner board application system and a robot.
Figure 13:
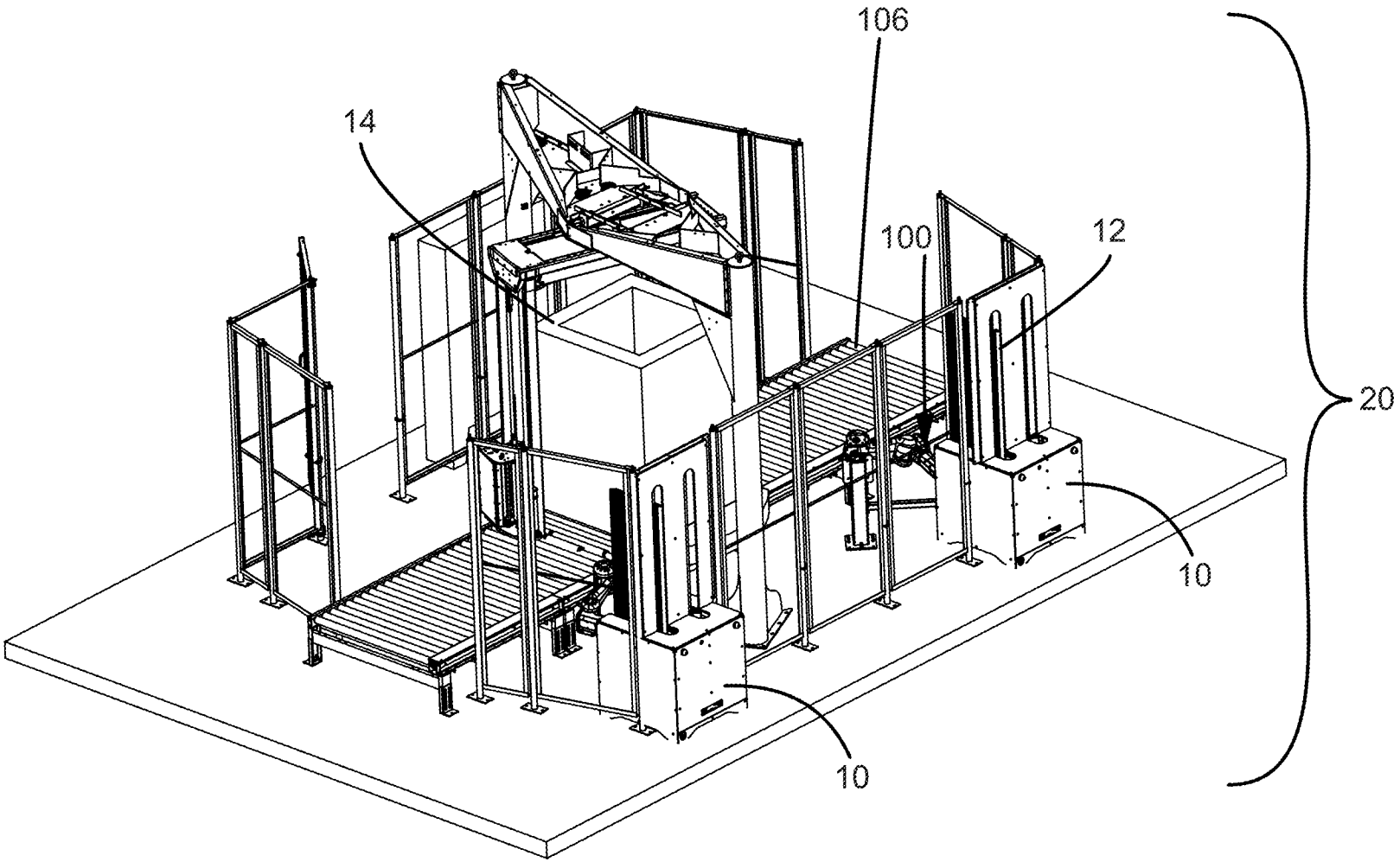
FIG. 13 is a view of the corner board application system as a part of a larger system, such as for wrapping loads.

Reference is now made to FIG. 1, which illustrates one example of a system 10 for applying corner boards 12 to a load 14 (see FIGS. 12 and 13). In particular, the system 10 of this particular example is adapted to dispense sequentially one or more corner boards 12 for application to one or more corners of a load 14. The load 14 may be a cuboid structure, but could have different shapes and any size, and typically comprises a plurality of objects or units. In forming the load, these objects or units may be palletized, then the corner board(s) 12 applied, and the entire assemblage wrapped prior to transport and storage of the goods, as outlined further in the following description.

In the embodiment illustrated in FIG. 1, the system 10 includes a magazine 16 for receiving the one or more corner boards 12. In the particular version shown, the magazine 16 is adapted to receive and hold a plurality of corner boards 12 upright in a stacked arrangement. However, the magazine 16 could hold only a single corner board 12, and be reloaded after each application of the corner board to the load 14.

The magazine 16 may include a loading end 18 for loading of the corner board(s) 12, as well as a dispensing end 20 for dispensing at least one of the corner boards for application to a corner of the load 14. As can be appreciated, the loading end 18 is located at the rear end of the magazine 16. The dispensing end 20 is located at the forward or front end, opposite the loading end 18. As can be appreciated, the dispending end 20 would be the end closest to the load 14 to which the corner board 12 is to be applied in the illustrated example.

Figure 2:
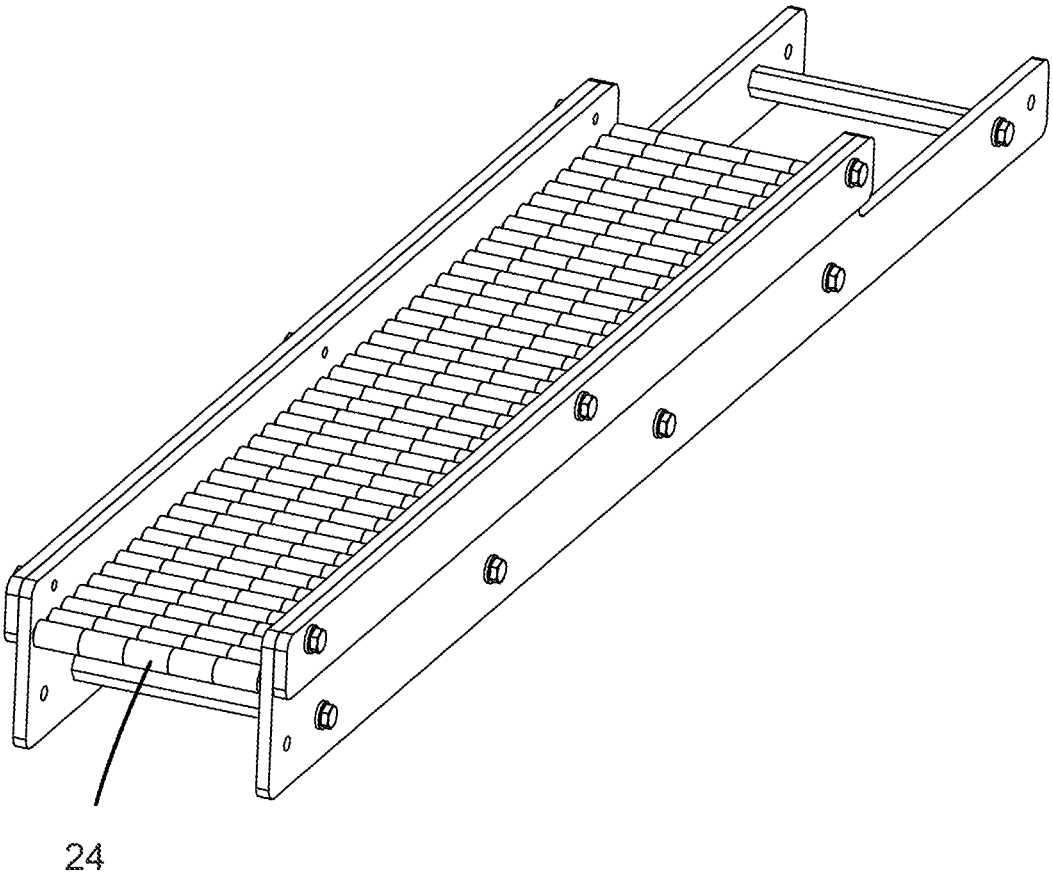
FIG. 2 is a view of a conveyor forming one part of the system.

The magazine 16 may comprise one or more lanes 22 for delivering the corner boards 12 between the loading and dispensing ends 18, 20. With continued reference to FIG. 1, and now also referencing FIG. 2, a conveyor 24 may be associated with the magazine 16 for supporting the stack of the corner boards 12. The conveyor 24 may comprise a passive roller conveyor adapted to provide low-friction support for the corner board(s) 12 during transport through the magazine 16, which may be adapted to accommodate the corner boards of varying shapes and sizes. The conveyor 24 may form one lane, and more than one conveyor may be present (such as for accommodating corner board(s) of different sizes).

Figure 3:
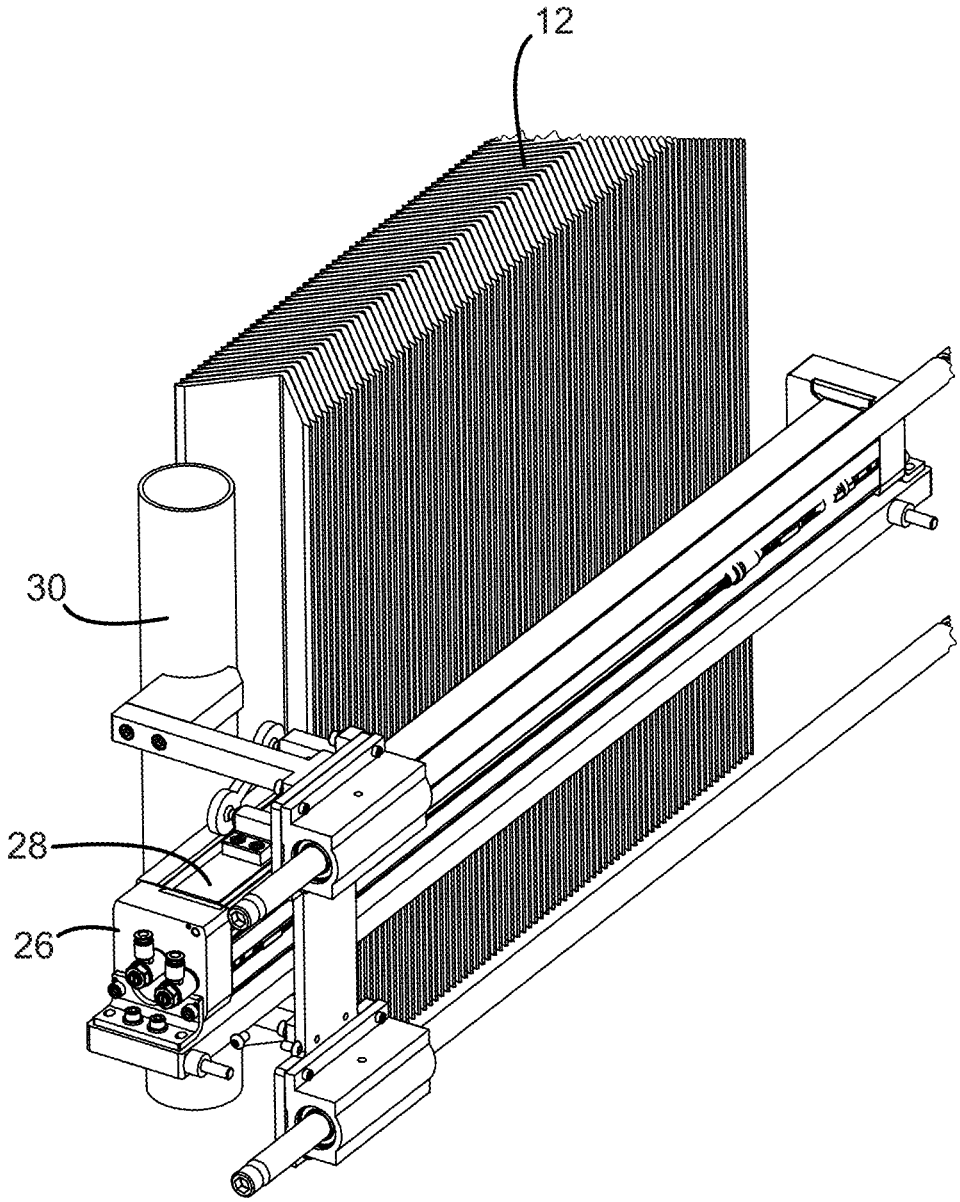
FIG. 3 is a view of a pusher forming another part of the system.
Figure 4:
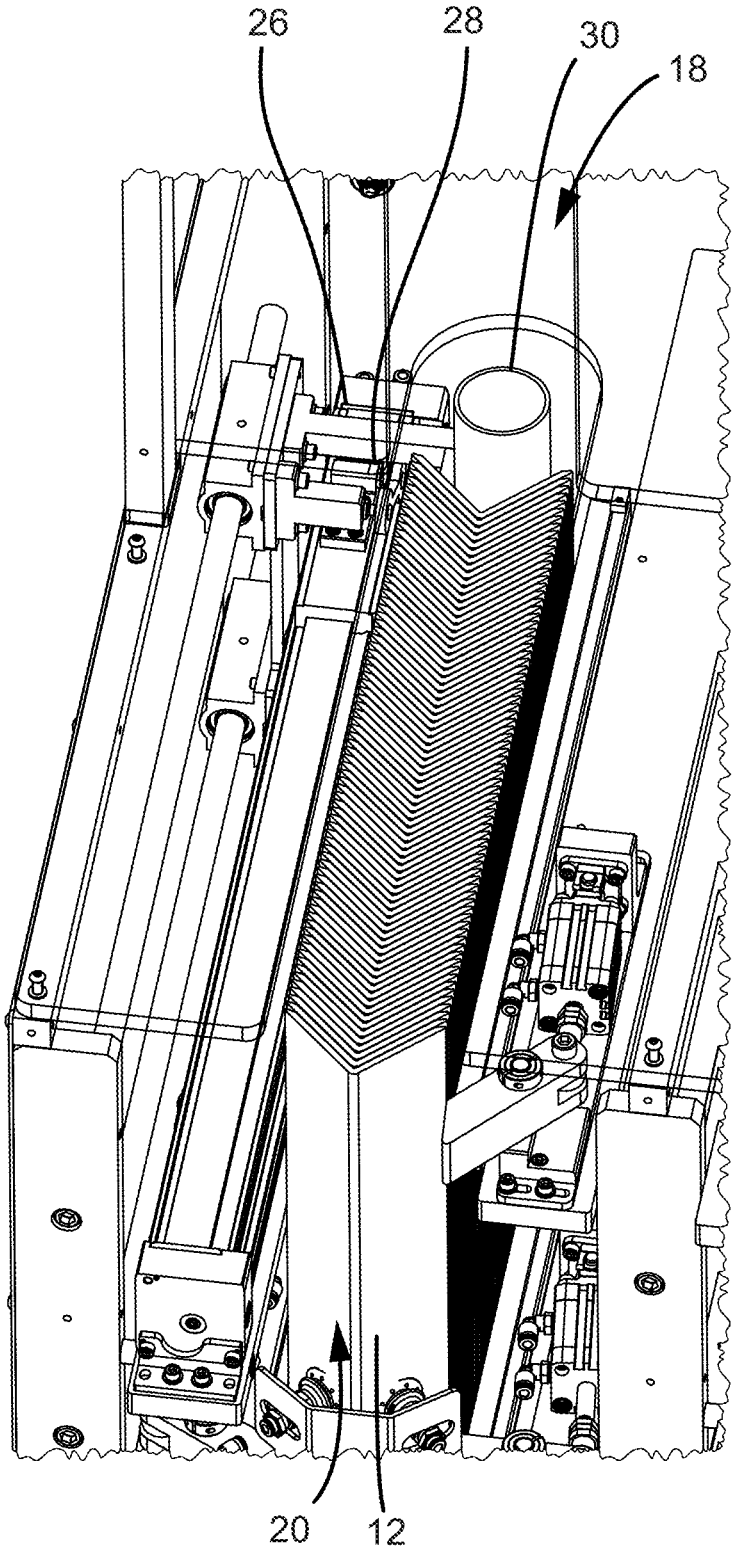
FIG. 4 is another view of the pusher.

The system 10 may also be adapted to advance the corner board(s) 12 towards the dispensing end 20 of the magazine 16 for dispensation and application to the load 14. Referring to FIGS. 3 and 4, this may be achieved by a pusher 26 for pushing the corner board(s) 12 towards the dispensing end 20 of the magazine 16. In one example, the pusher 26 may comprise a motorized linear actuator 28, such as a linear slide.

The linear actuator 28 may be attached to a support 30 for simultaneously advancing and assisting in supporting the corner board(s) 12 in an upright orientation. In the case of a stack, the support 30 may engage a rear surface of the trailing corner board to urge the entire stack towards the dispensing end 20 of the magazine 16. In one embodiment, the support 30 is of a cylindrical shape to maintain positive pressure on the adjacent surface(s) of the trailing corner board. In the typical application of corner board(s) 12 having an L-shaped cross-section, the rounded leading face of the cylindrical support 30 allows the stack of the corner boards 12 to "self-center" during transport along the magazine 16. The support 30 may be located near the loading end 18 of the magazine 16, relative to the stack of the corner boards 12 nearer the dispensing end 20 of the magazine 16.

Figure 5:
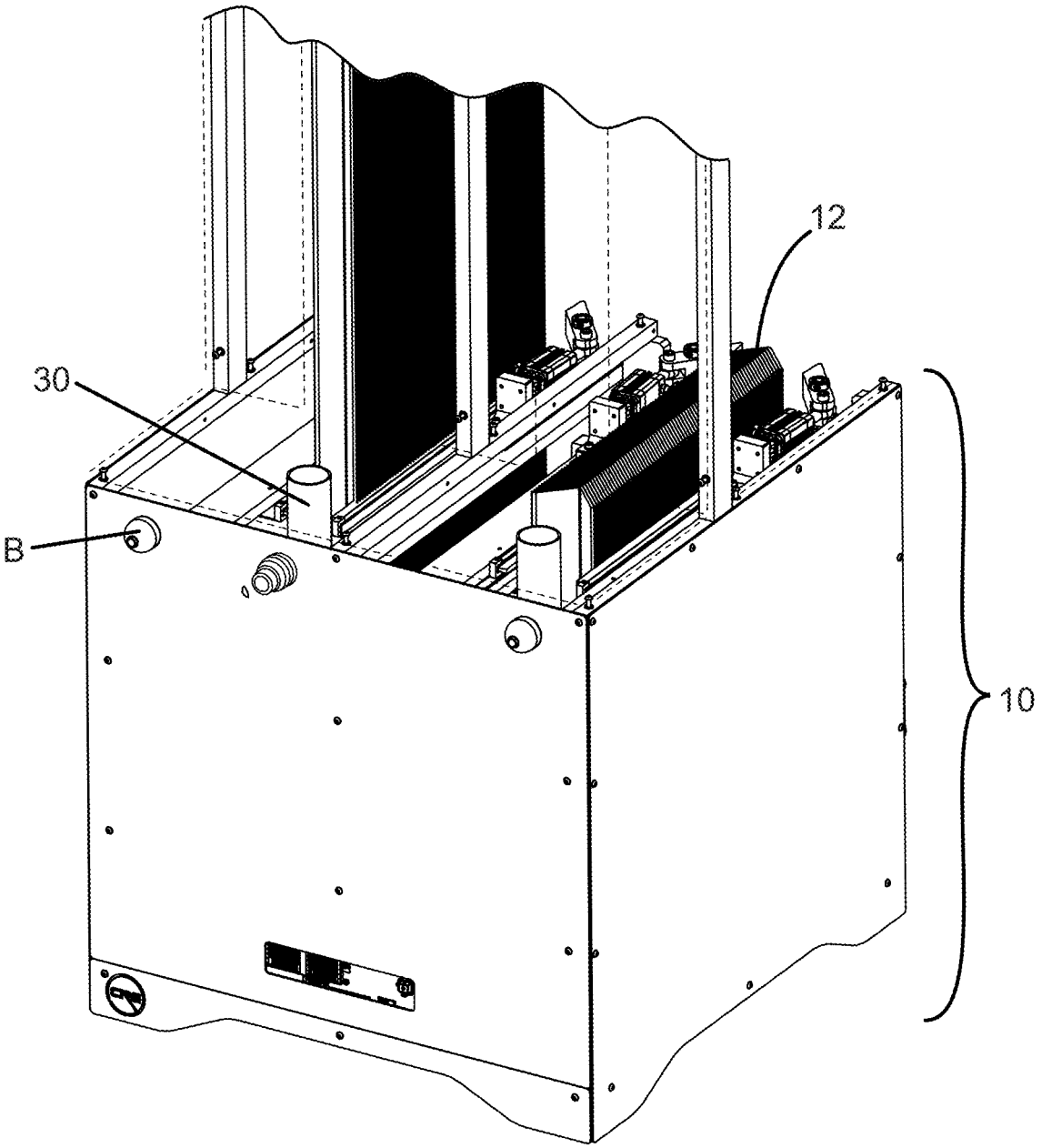
FIG. 5 is a rear view of the corner board application system.

To facilitate loading of the corner board(s) 12 into the magazine 16, the support 30 may be manually retracted to overcome a force created by the linear actuator 28 urging the support 30 towards the dispensing end 20. Alternatively, the retraction of the support 30 may be automated by pressing a load/unload button B, which is shown in FIG. 5, which would cause the actuator 28 to retract. Upon adding corner boards 12 to the magazine 16 during the loading process, the button B may again be pressed to return the support 30 to the active position for advancing and supporting the stack. Whether the retraction is manual or automatic, it can be appreciated that this feature allows for the corner board application system 10 to continue to dispense corner board (s) 12 without interruption during the reloading process.

Figure 6:
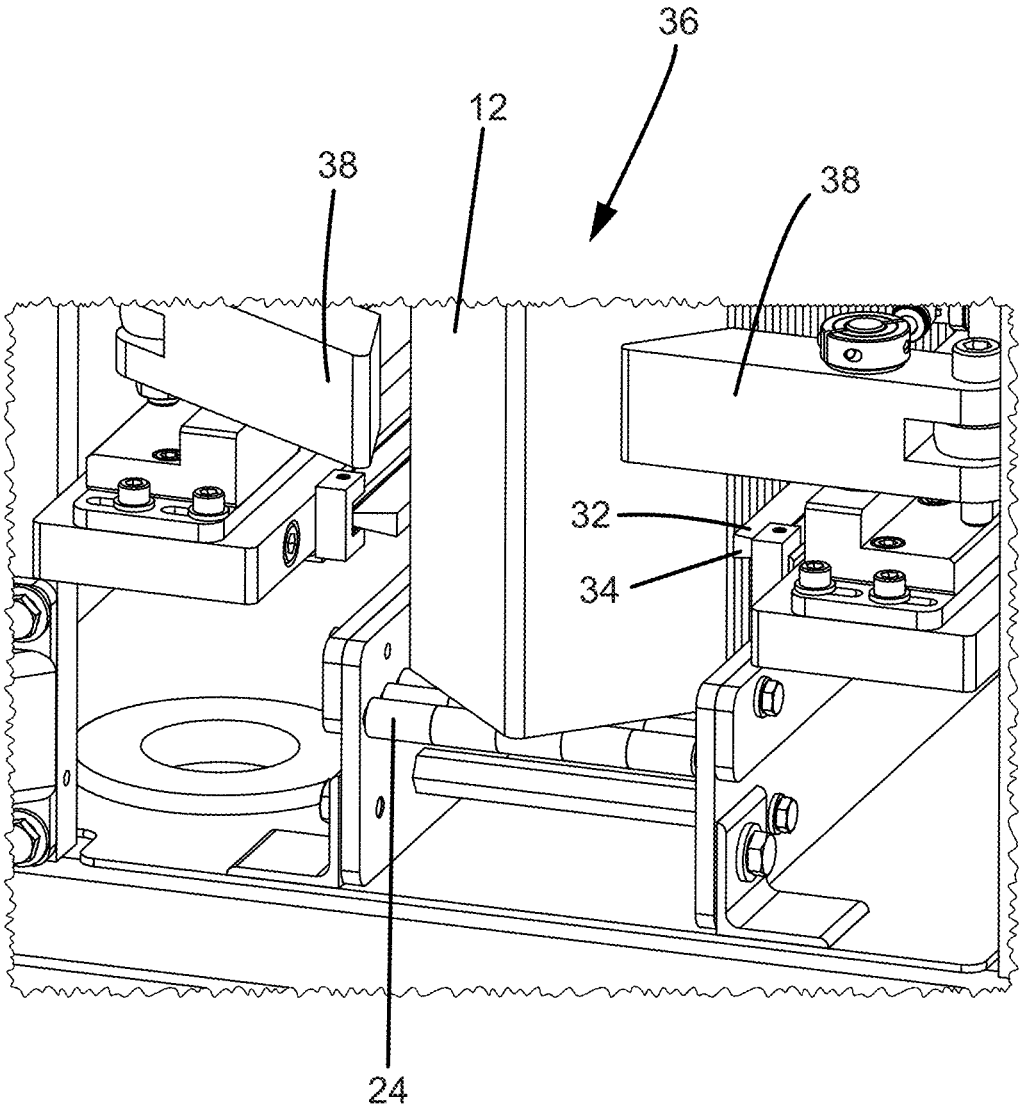
FIG. 6 is an enlarged partial view of the corner board application system.

As shown in FIG. 6, the system 10 may comprise a holder 32 for holding the corner board(s) 12 in an upright position within the magazine 16. In the illustrated example, the holder 32 includes two pairs of opposing brushes 34, such as tight-seal strip brushes with nylon bristles, that engaging and thus stabilize the corner board(s) 12 within the magazine 16. The opposing pairs of brushes 34 may occupy upper and lower positions relative to the corner board(s) 12 and longitudinally extend along the interior of the magazine 16. To ensure an appropriate amount of support is provided, the width dimension between an inner end portion of each opposing brush 34 may be less than the width of the corner board(s) 12 to ensure proper engagement, but without undue restraint in terms of movement through the magazine 16.

Figure 7:
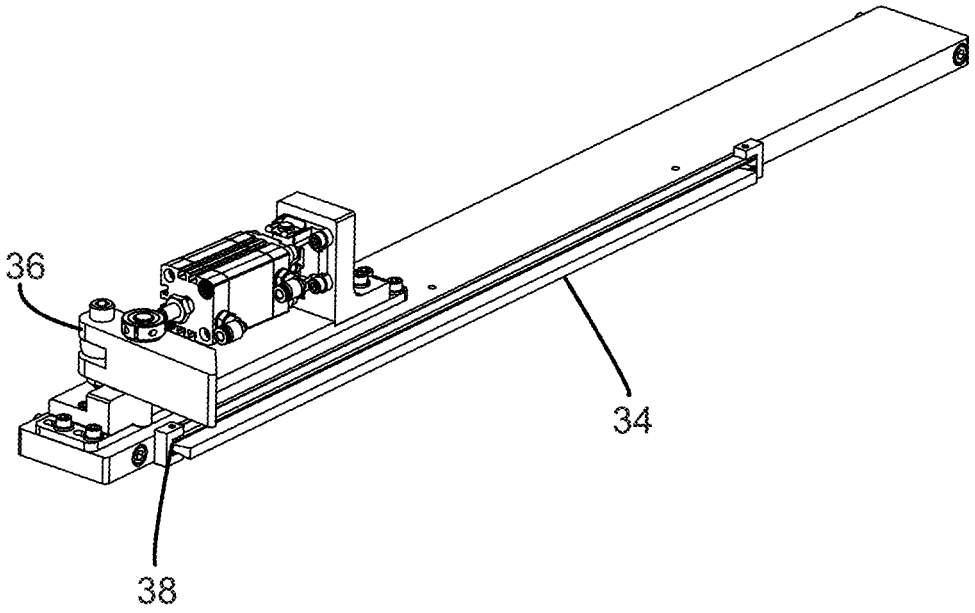
FIG. 7 is a view of a gate forming part of the system.
Figure 8:
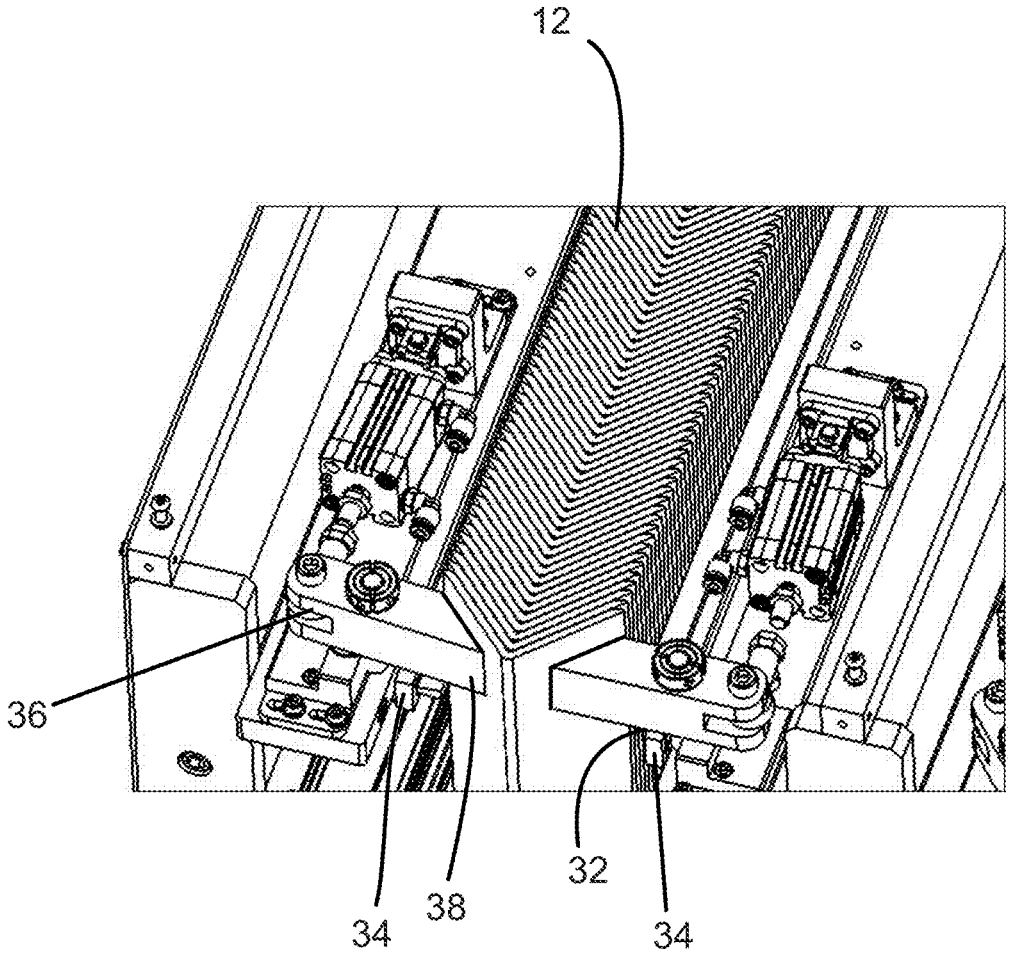
FIG. 8 is a view of the gate in a closed position.
Figure 9:
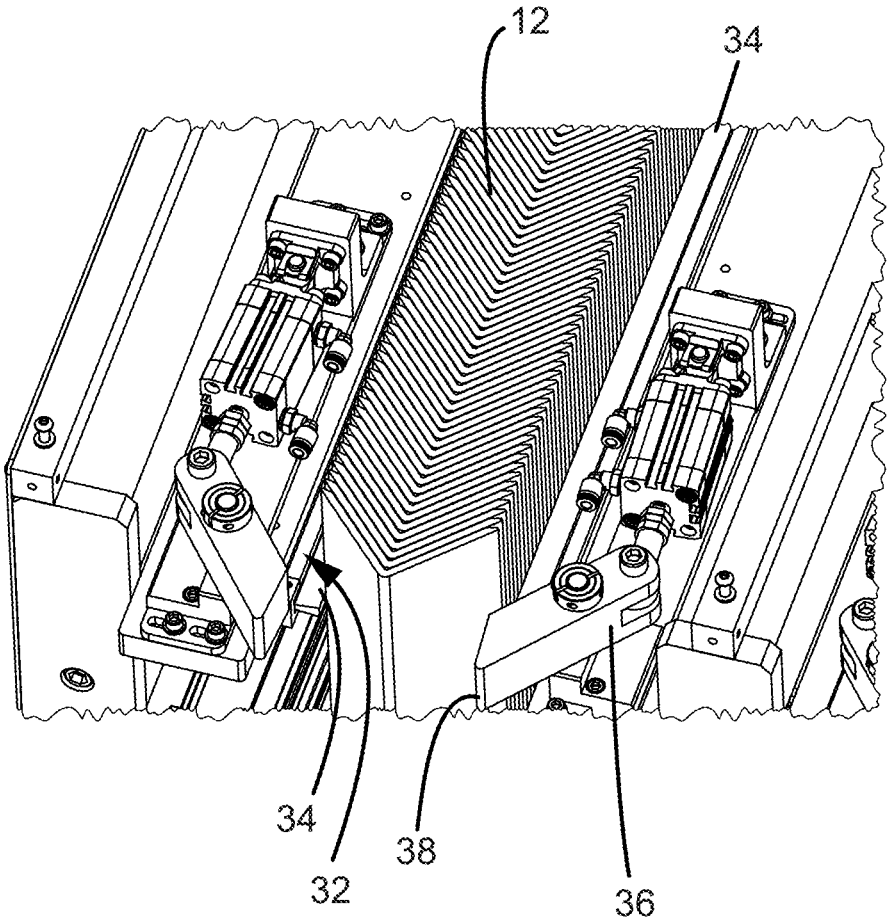
FIG. 9 is a view of the gate in an open position.

To allow for the release of a corner board 12 from the dispensing end 20 for application to the load 14, the system 10 may comprise a gate 36. As shown in FIGS. 7-9, this gate 36 may include a pair of fingers 38 adapted to pivot about a hinge point between a closed position for restraining the corner board 12 ready to be dispensed from the magazine 16 (FIG. 8), such as by direct engagement between the rear face of the fingers 38 and the front face of the one or leading corner board 12 and an open position for releasing the one or leading corner board for application to the load 14 (FIG. 9). In the closed position of FIG. 8, the gate 36 provides adequate back pressure to hold back the corner board 12 being urged forward by the pusher 26, which may be engaging a trailing corner board in a stack of corner boards in the magazine 16. The gate 36 thus provides a gating function for the one or more corner boards 12 and controls the manner of release for application to the load.

When the gate 36 is in an open position as shown in FIG. 9, a single corner board 12 may be released from the dispensing end 20 of the magazine 16. This release may be assisted by the urging of the support 30 when in the active position. In the case where a stack of corner boards 12 is present in the magazine 16, the brushes 34 may hold the upstream corner boards 12 in place when the gate 36 is in an open position, but these brushes do not restrain the leading corner board from being properly dispensed.

Figure 10:
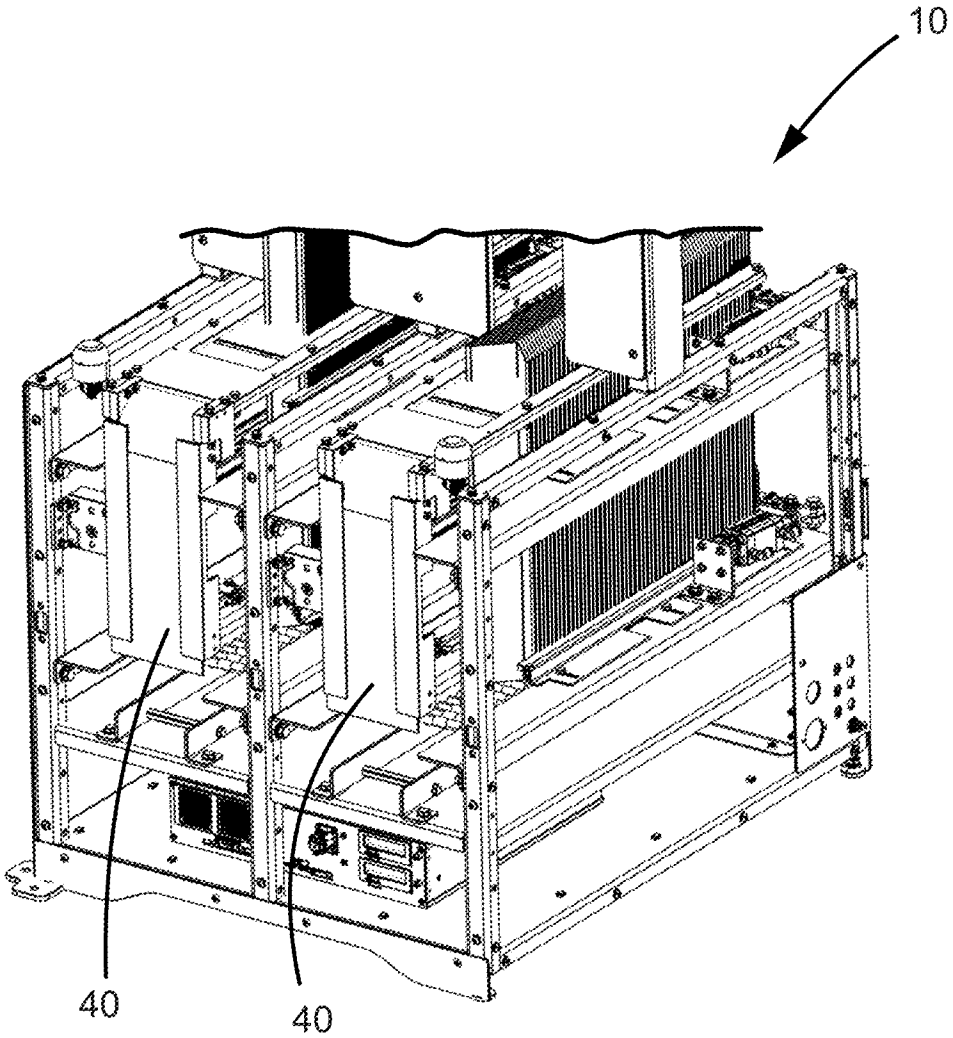
FIG. 10 is a rear view of the system.
Figure 10A:
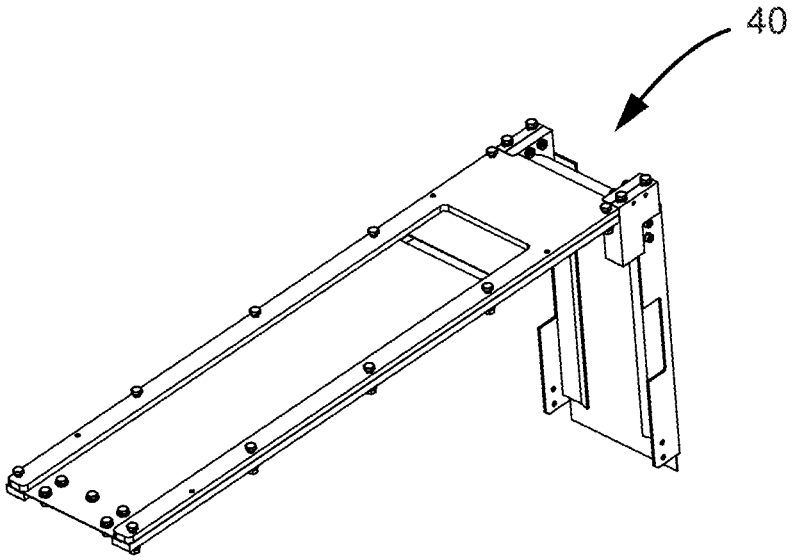
FIGS. 10A and 10B are front and rear perspective views of a guard for use in connection with the system.
Figure 10B:
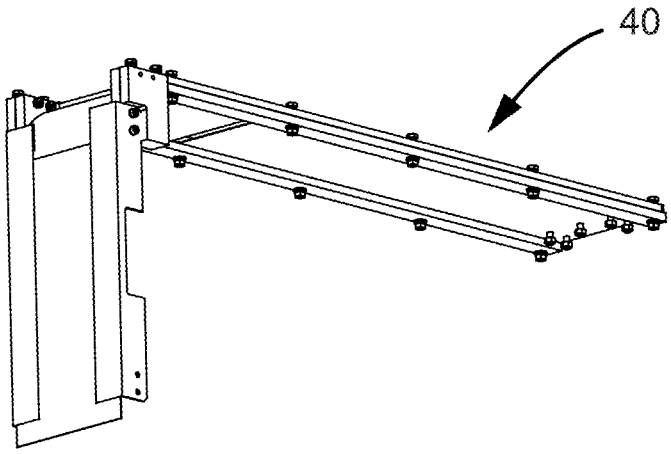

FIG. 10 shows that a shield in the form of a guard 40 may be associated with each magazine 16 of the system 10. The guard 40 is shown as being located adjacent to the loading end 18, and prevents external objects from entering into or interfering with the magazine 16. The guard 40 may comprise a generally L-shaped, flexible structure, as shown in FIGS. 10A and 10B, and may be connected to the pusher 26 to move to and fro along the same path of travel.

Figure 11:
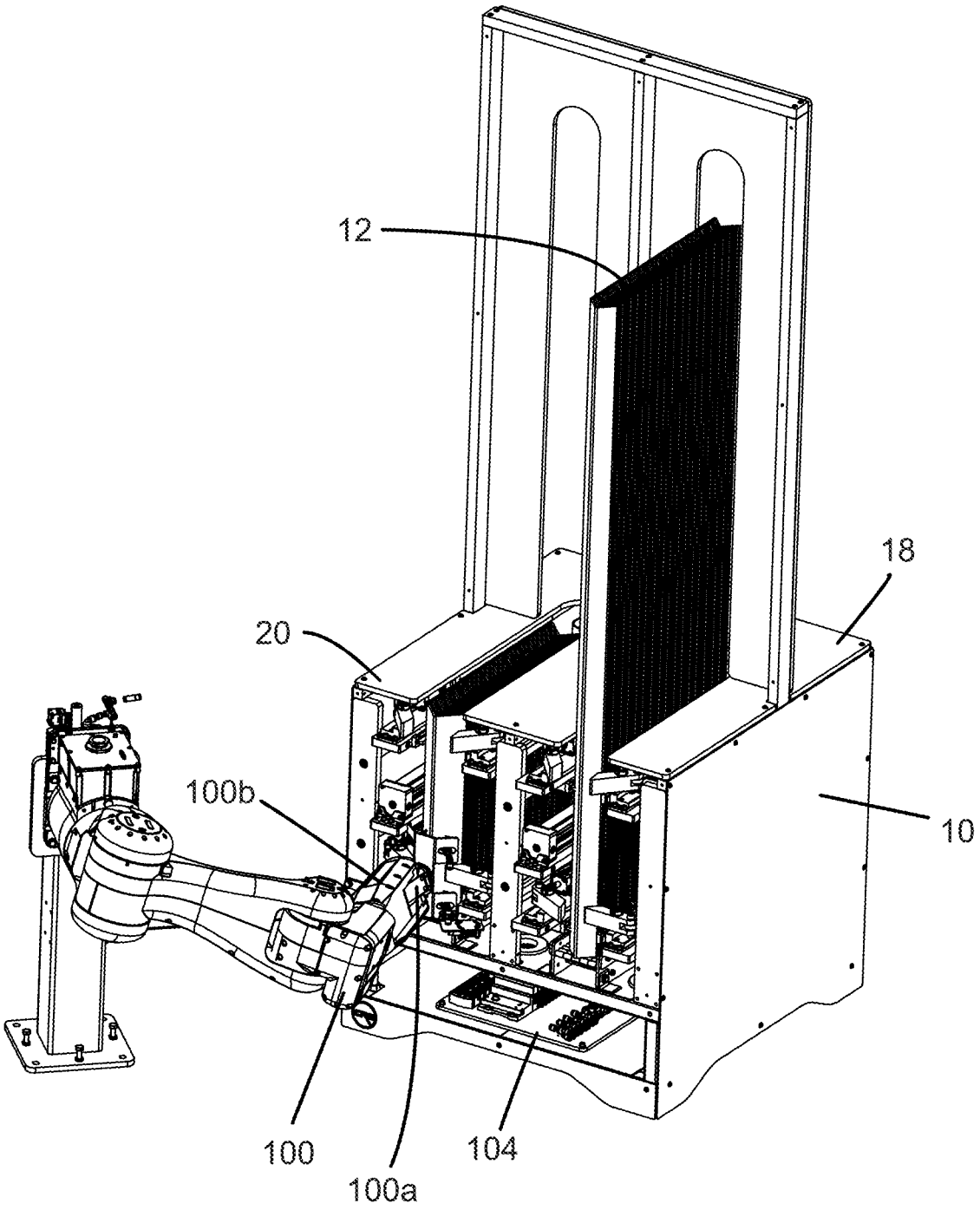
FIG. 11 is another view of the corner board application system and a robot.

With reference to FIGS. 11 and 12, the system 10 may be adapted to automatically apply the dispensed corner board 12 to the load 14. For example, a robot 100 may be used to pick and place the corner board 12 upon release from the magazine 16 to one corner of the load 14. In order to determine the appropriate placement location, one or more sensors 102 are provided for locating the one or more corners of the load 14 during transport relative to the system 10 and generating an output signal representative of the location. A controller 104 serves to control the robot 100 to place the corner board 12 at the sensed location based on the output signal.

The sensor(s) 102 may also facilitate determining when to apply the corner board 12. For instance, when the output signal signifies that the load 14 is approaching as a result of determining the location of the one or more corners thereof, the gate 36 may be triggered to assume the open positon. After the robot 100 extracts the leading corner board from the stack of the corner boards 12, the gate 36 may resume the closed position. The pusher 26 may then urge the stack of the corner boards 12 towards the dispensing end 20.

More specifically, the embodiment illustrated in FIG. 13 utilizes photo-eye corner detection for the load 14 to enable communication between the robot 100 and the corner board application system 10, though other methods of detection are available. For example, the robot 100 may include one or more sensors 100*a* on the end of an arm tool 100*b* to detect the edges of the corners on the load 14 as it reaches out to place the corner board 12. In another example, the sensor(s) 102 comprise distance measurement sensors placed on each side of a conveyor 106 for conveying the load 14 during processing. As the load 14 moves along the conveyor 106, the sensor(s) 102 may track the position of the load 14, providing the width position relative to the conveyor 106.

In order to determine the position, an encoder 108 may be attached to the conveyor 106 for indexing data as the load 14 moves along the conveyor 106. As the load 14 stops on the conveyor 106, the controller 104 may search for the first measured value in the array of position data obtained from each side of the conveyor 106. This is the X coordinate that may provide the distance the corresponding corner is away from each side of the conveyor 106.

The index/element number in the array corresponds to the Y coordinate, providing the location along (e.g., parallel to) the conveyor 106 where the corner is located relative to a fixed reference point. On the trailing edge of the load 14, the controller 104 may search for the non-measured value in the array located after the array element corresponding to the leading edge to locate the trailing edge of the load 14. The data in this array element minus one (the last measured value) may become the X coordinate, the distance from the edge of the conveyor 106 to the load 14 for the trailing edge corner. The array element this value is found in may provide the Y coordinate for the trailing edge location along (parallel to) the conveyor 106, from a fixed reference point.

Once the load 14 has transitioned through the sensor(s) 102, a two dimensional map of the load 14 may be available for use by the controller 104 in controlling the robot 100 to apply the dispensed corner board 12 to the correct location on the load 14. More specifically, the determined X and Y coordinates for each of the four corners may be used by the controller 104 to control the robot 100 for placing the corner board(s) 12 on the one or more corners of the load 14.

In one example, the corner board application system 10 may be a part of a larger system, such as a load wrapping system 200 including a wrapper that wraps the load 14 with a film or like containment structure once the corner boards 12 are applied thereto. In such a system 200, more than one corner board application system 10 may be used in the packaging process to speed up application of the one or more corner boards 12 to the load 14, as seen in FIG. 14.

As used herein, the following terms have the following meanings:

"A", "an", and "the" as used herein refers to both singular and plural referents unless the context clearly dictates otherwise. By way of example, "a compartment" refers to one compartment or more than one compartment.

"About," "substantially," or "approximately," as used herein referring to a measurable value, such as a parameter, an amount, a temporal duration, and the like, is meant to encompass variations of +/−20% or less, including+/−10% or less, +/−5% or less, +/−1% or less, and +/−0.1% or less of and from the specified value, in so far such variations are appropriate to perform in the disclosed invention. However, it is to be understood that the value to which such modifiers refer is itself also specifically disclosed.

"Comprise", "comprising", and "comprises" and "comprised of" as used herein are synonymous with "include", "including", "includes" or "contain", "containing", "contains" and are inclusive or open-ended terms that specifies the presence of what follows e.g. component and do not exclude or preclude the presence of additional, non-recited components, features, element, members, steps, known in the art or disclosed therein.

Although various aspects of the inventive concepts herein have been described in conjunction with specific embodiments, many alternatives, modifications, and variations will be apparent to those skilled in the art. Accordingly, this disclosure embraces all such alternatives, modifications, and variations that fall within the spirit and scope of the appended claims. All publications, patents and patent applications mentioned in this specification are herein incorporated in their entirety by reference into the specification, to the same extent as if each individual publication, patent or patent application was specifically and individually indicated to be incorporated herein by reference. In addition, the identification of any reference in this application shall not be construed as an admission that such reference is available as prior art to the present disclosure.

The invention claimed is:

1. A system for delivering one or more corner boards for application to one or more corners of a load, comprising:
- a magazine for receiving the one or more corner boards, the magazine including a loading end and a dispensing end;
- a pusher for pushing the one or more corner boards towards the dispensing end of the magazine;
- a holder for holding the one or more corner boards in an upright position within the magazine; and
- a gate adjacent the dispensing end of the magazine for gating at least one of the one or more corner boards for application to the one corner of the load.

2. The system of claim 1, wherein the magazine further includes a conveyor for supporting the one or more corner boards.

3. The system of claim 2, wherein the conveyor comprises a passive roller conveyor adapted to provide low-friction support for the one or more corner boards.

4. The system of claim 1, wherein the holder comprises a pair of opposing brushes.

5. The system of claim 4, wherein the holder comprises at least two pairs of brushes, including an upper pair for engaging an upper portion of the one or more corner boards and a lower pair for engaging a lower portion of the one or more corner boards.

6. The system of claim 4, wherein the opposing brushes extend longitudinally along the interior of the magazine.

7. The system of claim 6, wherein the one or more corner boards have a width, and a width dimension between an inner end portion of each brush is less than the width of the one or more corner boards.

8. The system of claim 1, wherein the gate comprises one or more fingers for engaging the at least one corner board in a closed position and having an open position for releasing the at least one corner board.

9. The system of claim 1, wherein the pusher comprises a linear actuator attached to a support for urging the one or more corner boards towards the dispensing end of the magazine.

10. The system of claim 9, wherein the support is adapted to be manually retracted to overcome an applied force urging the support towards the dispensing end, thereby allowing for the loading of the one or more corner boards into the magazine.

11. The system of claim 1, further including:
- one or more sensors for locating the one or more corners of the load and generating an output signal; and
- a controller for controlling a robot for placement of the one or more corner boards based on the output signal.

12. The system of claim 11, further including a conveyor with at least one sensor of the one or more sensors located on each side thereof to track a position of the load along the conveyor.

13. The system of claim 12, wherein the one or more sensors are located on an arm of the robot.

14. The system of claim 1, further including a removable guard connected to the pusher for guarding the dispensing end of the magazine.

15. The system of claim 1, further including a movable guard connected to the pusher for guarding the dispensing end of the magazine.

16. A system for delivering one or more corner boards for application to one or more corners of a load, comprising:
- a magazine adapted for receiving and holding a stack of the one or more corner boards, the magazine including a loading end and a dispensing end;
- a pusher for engaging a trailing corner board of the stack of the one or more corner boards for movement towards the dispensing end of the magazine;
- a holder for holding the stack of the one or more corner boards in an upright position within the magazine; and
- a gate adjacent the dispensing end for gating a leading corner board of the stack of the one or more corner boards for application to one corner of the load.

17. The system of claim 16, wherein the pusher comprises a linear actuator attached to a support for urging the stack of the one or more corner boards towards the dispensing end of the magazine.

18. A system for delivering one or more corner boards for application to one or more corners of a load, comprising:
- a magazine for receiving the one or more corner boards, the magazine including a loading end and a dispensing end;
- a linear actuator for pushing the one or more corner boards towards the dispensing end of the magazine;
- opposing brushes for holding the one or more corner boards in an upright position within the magazine; and
- fingers adjacent the dispensing end of the magazine for gating at least one of the one or more corner boards for application to the one corner of the load.

19. A system for delivering one or more corner boards for application to one or more corners of a load, comprising:
- a magazine adapted for receiving and holding a stack of the one or more corner boards, the magazine including a loading end and a dispensing end;
- a linear actuator for engaging a trailing corner board of the stack of the one or more corner boards for movement towards the dispensing end of the magazine;

opposing brushes for holding the stack of the one or more corner boards in an upright position within the magazine; and fingers adjacent the dispensing end for gating a leading corner board of the stack of the one or more corner boards for application to one corner of the load.

* * * * *